US012557838B1

(12) United States Patent
Almonte et al.

(10) Patent No.: US 12,557,838 B1
(45) Date of Patent: Feb. 24, 2026

(54) METHOD AND APPARATUS FOR A SMOKING SHELL WITH AN INSULATING HOLDER AND SELECTABLE FILTER TIP

(71) Applicant: IP TRADEMARK HOLDINGS INC, Mandeville, LA (US)

(72) Inventors: Pedro Almonte, Santiago (DO); Matthew Brenton Sinclair, Covington, LA (US)

(73) Assignee: IP Trademark Holdings, Inc., Mandeville, LA (US)

( * ) Notice: Subject to any disclaimer, the term of this patent is extended or adjusted under 35 U.S.C. 154(b) by 434 days.

(21) Appl. No.: 18/343,478

(22) Filed: Jun. 28, 2023

(51) Int. Cl.
*A24F 1/28* (2006.01)
*A24F 1/26* (2006.01)

(52) U.S. Cl.
CPC . *A24F 1/28* (2013.01); *A24F 1/26* (2013.01)

(58) Field of Classification Search
CPC ..... A24F 1/26; A24F 1/28
See application file for complete search history.

(56) References Cited

U.S. PATENT DOCUMENTS

2014/0202475 A1* 7/2014 Liu ..... A24F 40/40 131/329
2016/0255879 A1* 9/2016 Paprocki ..... A24F 40/46

FOREIGN PATENT DOCUMENTS

CN 110089777 A * 8/2019 ..... A24F 47/008
WO WO-2020173125 A1 * 9/2020 ..... A24F 40/20

* cited by examiner

*Primary Examiner* — Cynthia Szewczyk
(74) *Attorney, Agent, or Firm* — Roy Kiesel Ford Doody & North, APLC; Brett A. North

(57) ABSTRACT

A smoking product and method of making thereof for the consumption of a smokable substance which includes a smoking tube having a tube interior; an insulator ring having an insulator annular area, and an open insulator interior, wherein the insulator ring is located in the tube interior, wherein the insulator annular area is filled with a first insulating material, and wherein the insulator ring has an insulation efficiency of between 50 and 95 percent; a support having upper and lower support ends, wherein the support is inserted in the tube interior and resisting collapse of the tube against an external force; a filter element located outside of both the tube interior and the open insulator interior, and wherein the smoking tube, insulator ring, and filter element are packaged for sale in packaging.

21 Claims, 12 Drawing Sheets

METHOD AND APPARATUS FOR A SMOKING SHELL WITH AN INSULATING HOLDER AND SELECTABLE FILTER TIP

BACKGROUND OF THE INVENTION

The present invention relates to smoking articles such as preformed smoking shells whether conically or cylindrically shaped. More particularly, the present invention relates to improved preformed smoking shell, packaged for sale in an unfilled state and having an insulating member located in the interior of the smoking shell, wherein the longitudinal insulating member has a longitudinal length that is less than the longitudinal length of the smoking shell, and where longitudinal insulating member has an member interior in which a selected filter tip can be inserted therein allowing a consumer to support the smoking shell from the outside at a location immediately above the insulating member such that the insulating member blocks the radial transmission of heat emitted from the filter tip to a user which may hold the shell while smoking.

Many smokers prefer to use their own smokable filler product as opposed to purchasing cigars that are already constructed and filled with a manufacturer's selection of smokable filler. These users of fine, custom smokable filler prefer to start with an empty preformed smoking shell, which they prefer to purchase, and then fill it with their own custom smokable filler after the smoking shell has been removed from its package.

SUMMARY OF THE INVENTION

Various embodiments relate generally to products for the consumption smokable substances, and more particularly to a product and method of making thereof for the consumption of smokable substances having a hollow cylindrical or conical smoking shell which includes a longitudinal insulating member having a longitudinal length that is less than the longitudinal length of the smoking shell, and where longitudinal insulating member has an insulating interior in which a selected filter tip can be inserted therein allowing a consumer to support the smoking shell from the outside at a location immediately above the insulating member such that the insulating member blocks the radial transmission of heat emitted from the filter tip.

During the process of smoking, smokable filler located in the interior of the smokable shell is ignited and burns. A user inhaling on the end having the filter tip causes such heated smoke to migrate along the longitudinal length of the smoking shell, passing through the filter tip, and entering the user's mouth. The heated smoke passing through the filter tip can cause the tip to increase in temperature thereby causing the tip to emit heat which has the potential of traveling radially through the wall of the smokable shell and into the user's fingers. The insulating member substantially blocks/slows down the radial transmission of such emitted heat thereby reducing the risk of the user burning his/her fingers.

Whereas "heat" can be a form of energy that causes substances to rise in temperature or go through associated changes (melting, evaporation or expansion).

Whereas "insulate" can be the preventing or slowing the transfer of electricity, heat or sound from one environment to another.

Whereas "insulator" is a substance that substantially resists the flow of heat, electricity or sound through it.

Various embodiments relate generally to products and methods of making thereof, for consumption of smokable filler such as herbs and other smokable substances.

In various embodiments is provided a product that is easy to use and provides for a superior smoke.

In various embodiments is provided a method of making a cylindrical or conical smoking shell for the consumption of smokable substances resulting in a product that is easy to fill and finish, and provides for a consistent quality smoke.

In various embodiments is provided packaging for packaging the hollow cylindrical or conical smoking shell. In various embodiments the packaging can be a container, pouch, a bag, a flexible wrapper, or a tube.

In various embodiments is provided an elongated member for packing or tamping smokable substances into the hollow cylindrical or conical smoking shell when packaged for sale.

In various embodiments, a push rod or tamper can be included in with the smokable shell. In various embodiments, the push rod can be nested inside the smokable shell.

In various embodiments a conical smoking shell has an outer surface, a large diameter end, a small diameter end, and a cavity that extends from the large diameter end to the small diameter end.

In various embodiments the cylindrical or conical smokable shell can be comprised of smokable materials chosen from any combination of the following materials: natural leaf, homogenized tobacco paper, pipe tobacco, different types of flavored tobacco, cellulose (clear, opaque, or colored), bleached or non-bleached paper, cigarette paper, rice paper, herbal materials, homogenized hemp, rice paper, smoking paper tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, Leonurus Sibericus Flowers, Wild Dagga Flowers, Klip Dagga Leaf, Damiana, Hookah, hemp, Hemia salicifolia, Kava Kava, Avena Sativa, scotch broom topps, Valarian, capillarius, herba, Wild clip dagga, Leonurus sibiricus, Kanna, Sinicuichi, chocolate, herbal components, and/or lactuca virosa.

In various embodiments smokable filler material can be selected from any combination of the following types of filler material: smoking tobacco, pipe tobacco, different types of flavored tobacco, herbal materials, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, Leonurus Sibericus Flowers, Wild Dagga Flowers, Klip Dagga Leaf, Damiana, Hookah, Hemia salicifolia, Kava Kava, Avena Sativa, scotch broom topps, Valarian, capillarius, herba, Wild clip dagga, Leonurus sibiricus, Kanna, Sinicuichi, and/or lactuca virosa.

In various embodiments the cylindrical or conical smoking shell, filter tip, and/or smokable filler can include liquid for moisturizing, and also preferably includes flavoring and/or scenting. The liquid can be, in whole or in part, water, alcohol, solvent, oil, propylene glycol, ethyl alcohol, glycerin, benzyl alcohol as examples. The liquid can be flavored and/or scented with items such as for example apple, apple martini, berries, blueberry, champagne, chocolate, coco/vanilla, cognac, cosmo, gin, grape, honey, lychee, mango, menthol, mint choco, peach, pina colada, punch, purple, rum, strawberry/kiwi, vanilla, watermelon, wet cherry, and/or whiskey. This flavored liquid is typically applied at levels of between about 0.01 to 45% by weight, and preferably between about 0.1% to 10% by weight. This flavored liquid is typically applied to the at least one pre-rolled sheet with a carrier liquid such as ethyl alcohol, propylene glycol, water or the like. Glycerin and invert sugar can also be used as a carrier. Some humectants can also be used, however, little or no humectants can be used. In general terms, the flavors can be provided by botanical extracts, essential oils, or artificial flavor chemicals, any one of which or a combination thereof mixed with a carrying solvent such as propylene glycol, ethyl alcohol, glycerin, benzyl alcohol, or other alcohol, for example. Other flavors can include cocoa, licorice, coffee, vanilla or other botanical extracts. Essentials oils can be used such as wine essence, cognac oil, rose oil, mate or other oils.

In various embodiments the filter tip can be comprised of glass or metal with one or more gaseous flow pathways.

Preferably, the insulator section has a length that is between 10 and 60 mm. More preferably the length is between 10 and 50 mm. More preferably the length is between 10 and 40 mm. More preferably the length is between 10 and 35 mm. More preferably the length is between 10 and 25.2 mm.

In various embodiments insulator may be formed of a thermoplastic synthetic resin such as a foamed low-to-medium density polymer including, but not limited to, polyethylene, polyolefin, polyvinylchloride, polystyrene, polyester, nylon, and other similar materials that would be suitable for use as an insulating layer. In various embodiments insulator may be formed from corrugated paper having air gaps therein.

Insulation can be classified into three groups according to the temperature ranges for which they are used.

Low-Temperature Insulation (Up to 90° C.)

The commonly used materials are cork, wood, 85% magnesia, mineral fibers, polyurethane and expanded polystyrene, etc.

Medium-Temperature Insulation (90-325° C.)

The types of materials used in this temperature range include 85% magnesia, asbestos, calcium silicate, mineral fibers, etc.

High-Temperature Insulation (325° C. And Above)

The most extensively used materials in this range are asbestos, calcium silicate, mineral fibers, mica- and vermiculite-based insulation, fireclay- or silica-based insulation, and ceramic fibers.

Insulation Material

Insulation materials can also be classified into organic and inorganic types. Organic insulations are based on hydrocarbon polymers, which can be expanded to obtain high void structures. Examples include Thermocol (expanded polystyrene) and polyurethane foam (PUF).

Inorganic insulation is based on siliceous/aluminous/calcium materials in fibrous, granular, or powder forms. Examples include mineral wool, calcium silicate, etc.

Properties of common insulating materials follow:

Calcium Silicate

This is used in industrial process plant piping where high service temperature and compressive strength are needed. Temperature range varies from 40 to 950° C.

Glass Mineral Wool

This is available in flexible forms, rigid slabs, and preformed pipe work sections. It is good for thermal and acoustic insulation for heating and chilling system pipelines. The temperature range of application is −10 to 500° C.

Thermocol

This is mainly used as cold insulation for piping and cold storage construction.

Expanded Nitrile Rubber

This is a flexible material that forms a closed cell integral vapor barrier. Originally it was developed for condensation control in refrigeration pipe work and chilled water lines; nowadays it is also used for ducting insulation for air conditioning.

Rock Mineral Wool

This is available in a range of forms from lightweight rolled products to heavy rigid slabs including preformed pipe sections. In addition to good thermal insulation properties, it can also provide acoustic insulation and is fire retardant.

Thermal Efficiency

Thermal efficiency expresses the effectiveness of some particular piece of insulation in preventing heat loss from some particular surface. It may be written simply as the ratio or expressed as a percentage.

$$\text{Thermal efficiency}=[Q_{\text{without insulation}}-Q_{\text{with insulation}}]/Q_{\text{without insulation}}\times 100\%$$

Materials

In one or more embodiments the following types of insulation materials can be used: 1. Mineral Fiber Preformed Thermal Insulation;

2. Calcium Silicate Preformed Thermal Insulation;
3. Cellular Glass/Foam Glass Thermal Insulation;
4. Corkboard and Cork Pipe Thermal Insulation; and
5. Preformed Rigid-Cellular Polyurethane (PUR) and Polyisocyanurate (PIR) Thermal Insulation.

1. Mineral Fiber Preformed and Blanket-Type Thermal Insulation.

The chemical composition for the major constituents of mineral fiber preformed insulating materials is preferably are preferably (when tested by spectrometric methods):

$SiO_2$=30-45 weight %
$Al_2O_3$=8-15 weight %
$TiO_2$=2-4 weight %
$Fe_2O_3$=2.5 max. weight %
CaO=30-35 weight %
MgO=6-12 weight %
$Na_2O$=0-1 weight %
$K_2O$=0-1 weight %
$P_2O_5$=0-1 weight %
Water-soluble chloride: approximately 6 mg/kg when tested in accordance with ASTM C871

The thermal conductivity preferably is less than 0.065 W/mK at 200° C. (when tested in accordance with ASTM Test Method C177).

2. Calcium Silicate Preformed Thermal Insulation.

Calcium silicate thermal insulation preferably is comprised predominately of reacted hydrous calcium silicate and typically incorporates a fibrous reinforcement. The thermal conductivity preferably is less than 0.039 W/mK at 200° C. when tested in accordance with ASTM Test Method C177.

3. Cellular Glass/Foam Glass Thermal Insulation.

The material preferably is a glass composition that has been foamed or cellulated under molten conditions, annealed, and set to form a rigid incombustible material with hermetically sealed cells. The thermal conductivity of cellular glass thermal insulation is preferably less than 0.045 W/mK (when tested in accordance with ASTM Test Method C177).

4. Corkboard and Cork Pipe Thermal Insulation.

Corkboard and cork pipe insulation preferably is a compressed and baked granulated cork, without added binder. The thermal conductivity is preferably less than 0.042

W/mK at 24° C. (when tested in accordance with ASTM Test Method C177 and Test Method C518).

5. Preformed Rigid-Cellular Polyurethane (PUR) and Polyisocyanurate (PIR) Thermal Insulation.

The material preferably is comprised of a rigid polyurethane or rigid polyisocyanurate foam with closed cell structure. The thermal conductivity is preferably less than 0.023 W/mK at 20° C. (when tested in accordance with ASTM Test Method C17).

In various embodiments the insulation can be selected from the group consisting of: silicon, rubber, glass, cork, perlite, ceramic, teflon, and insulating foam (e.g., urethane or polyurethane). In various embodiments the insulation can be selected from a combination of one or more of the above referenced insulating materials.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF DESCRIPTION OF DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
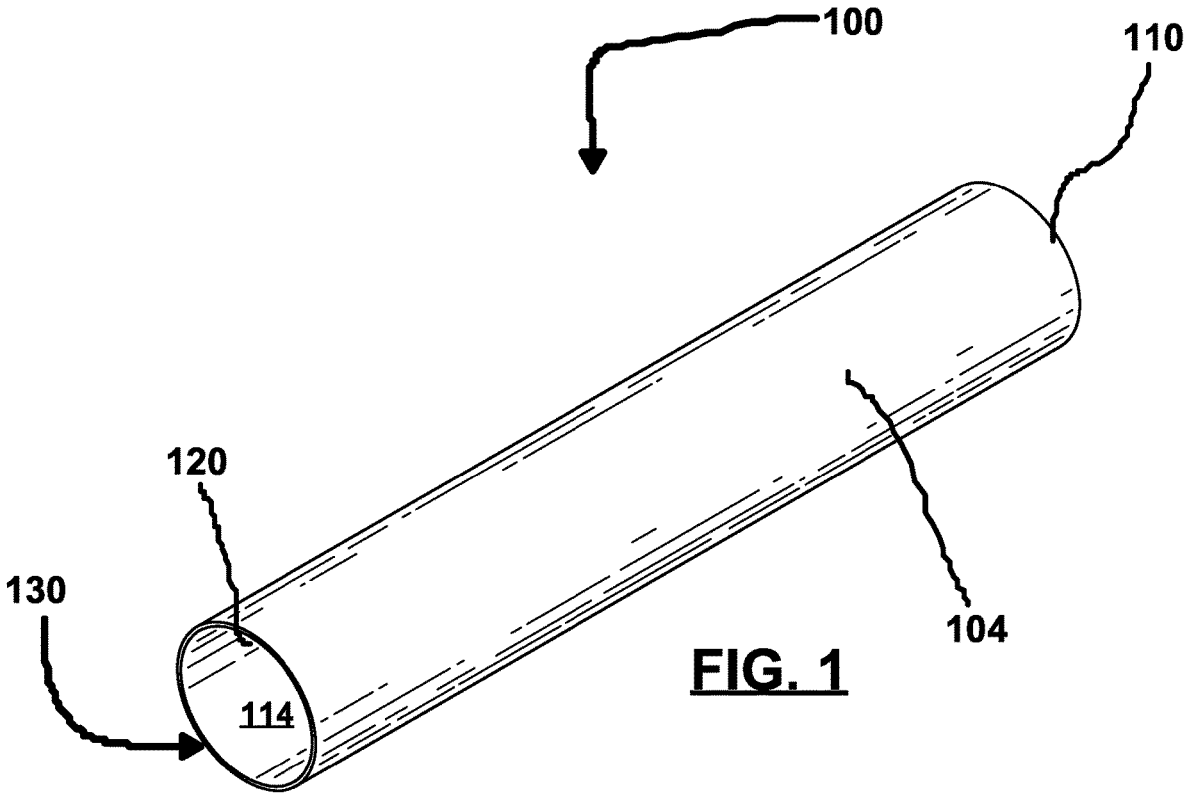
FIG. 1 is a perspective view of an unfilled cigar shell.

FIG. 1 is a perspective view of an unfilled cigar shell 100 which can comprise first end 110, second end 120 with inner surface 114, side wall 104, and interior 130.

Figure 2:
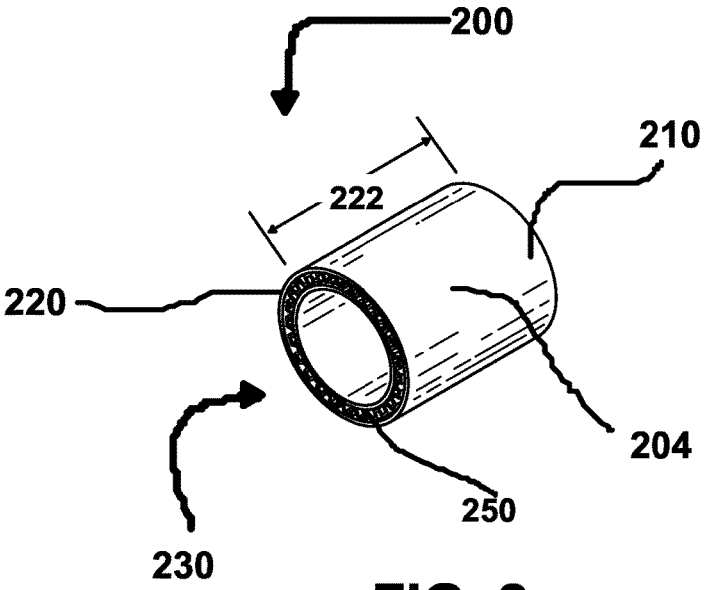
FIG. 2 is a perspective view of an insulation ring which can be placed in the interior of the cigar shell, wherein the insulation ring has an interior which can accept a filter tip.

FIG. 2 is a perspective view of an insulation ring 200 which can be placed in the interior 130 of the cigar shell 100, wherein the insulation ring 200 has an interior 230 which can accept a filter tip 1200. Insulation ring 200 can comprise first end 210, second end 220 with inner surface 206, exterior surface 204, and interior 230. Between inner 206 and exterior 204 surfaces can be an insulating material 250 which can resist radial heat flow substantially more than sidewall 104 of shell 100. Insulating ring 200 has a longitudinal length shown by dimension 222.

Figure 3:
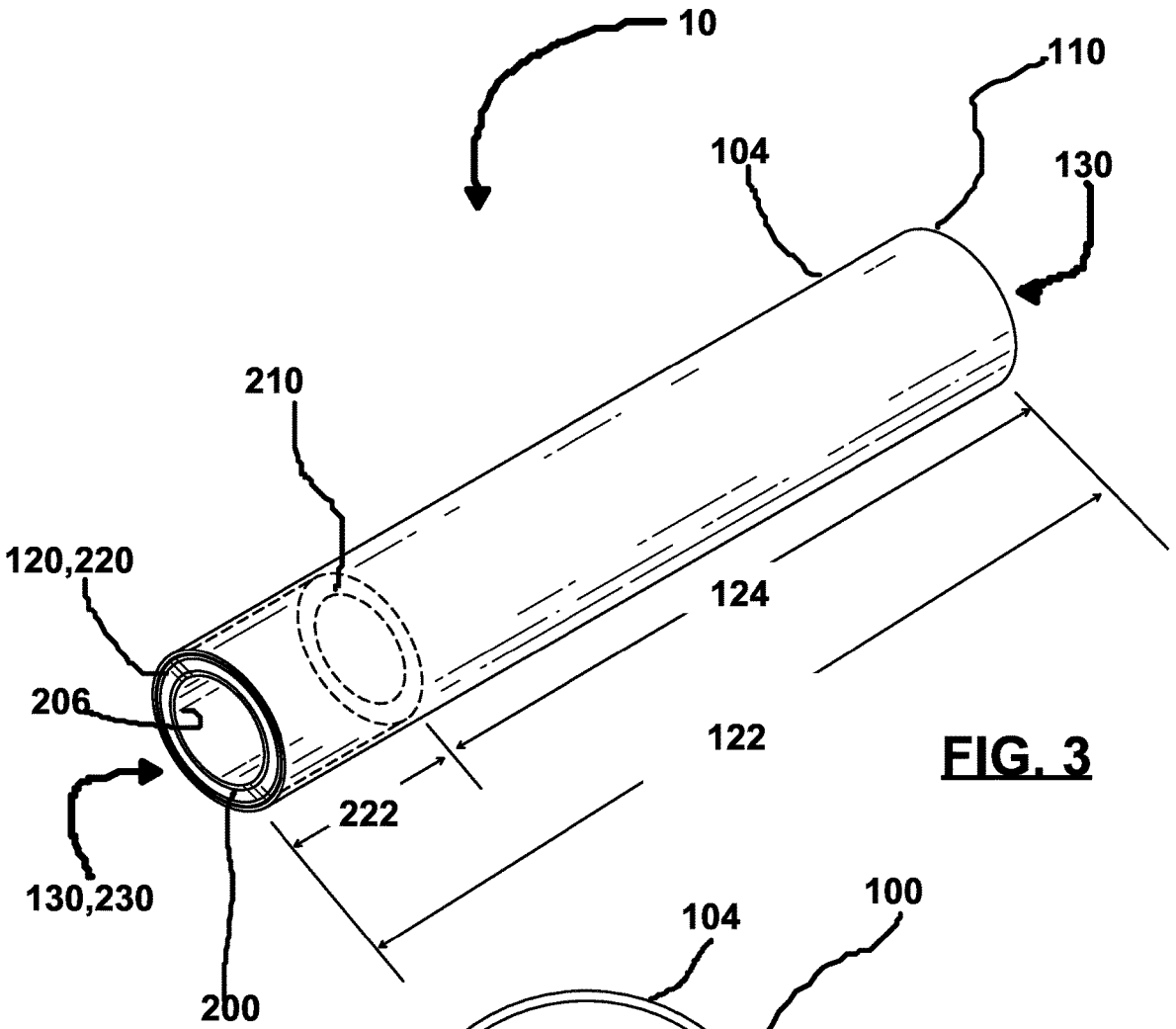
FIG. 3 is a perspective view of the insulation ring of FIG. 2 now placed in the interior of the cigar shell of FIG. 1.
Figure 4:
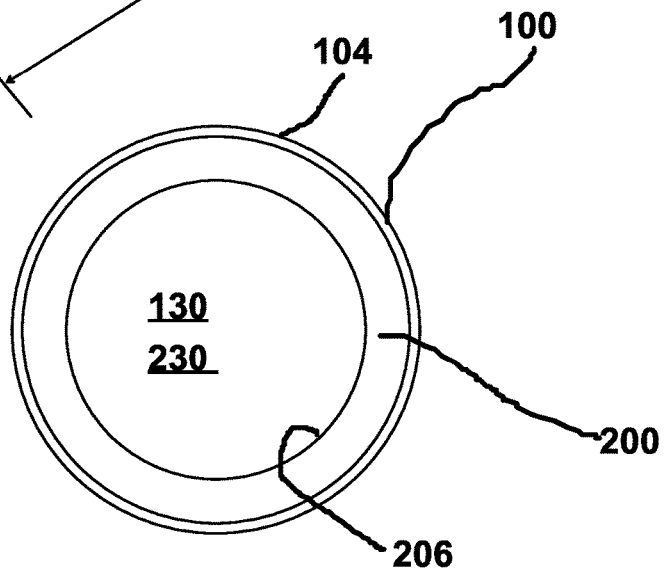
FIG. 4 is an end view of the cigar shell/insulation ring of FIG. 3.

FIG. 3 is a perspective view of the insulation ring 200 now placed in the interior 130 of the cigar shell 100. FIG. 4 is an end view of the cigar shell 100/insulation ring 200. As will be explained below insulation ring 200 will vastly increase resistance to radial heat flow during smoking of finished smoking article 10 from heated smoke passing along the longitudinal axis of shell 100 compared to the situation of heat flow through sidewall 104 not having insulation ring 200.

Figure 5:
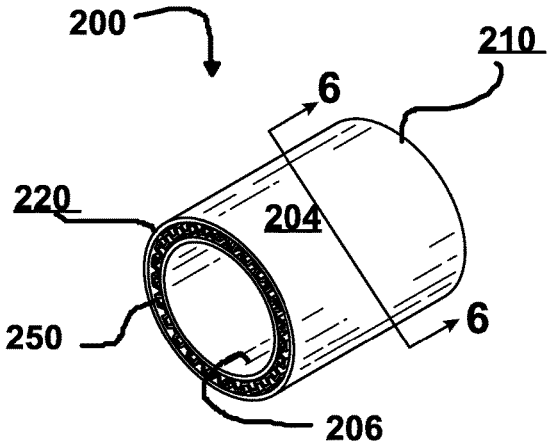
FIG. 5 is a perspective view of an insulating ring.
Figure 6:
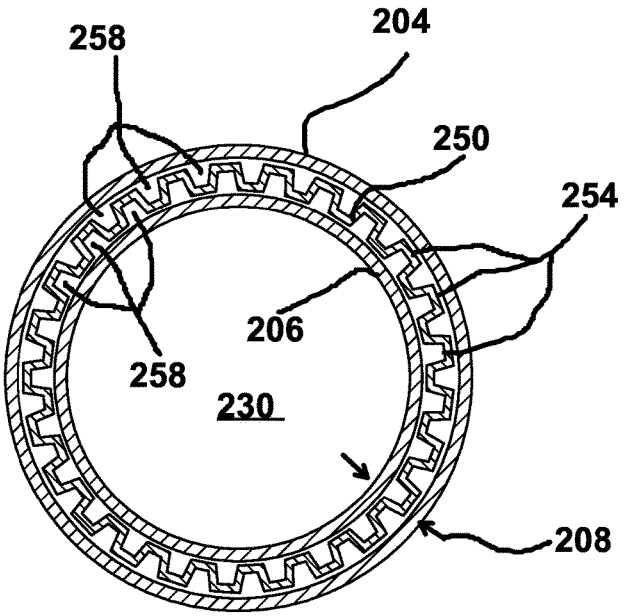
FIG. 6 is a sectional view of FIG. 5 taken along lines 6-6 showing a first embodiment of insulating ring.

FIG. 5 is a perspective view of an insulating ring 200. FIG. 6 is a sectional view of a first embodiment of insulating ring 200 taken along lines 6-6. In this embodiment an insulating material 250 is provided in the gap 208 between interior 206 and exterior 204 of insulation ring 200. Insulating material can be "corrugated" having a plurality of peaks 254 and a plurality of valleys 256. The total insulating effect of insulating material is the combination of: (i) insulating value of insulation material 250, (ii) insulating value of the plurality of valleys 256, and (iii) insulating value of the interior wall 206 and exterior wall 204.

Figure 7:
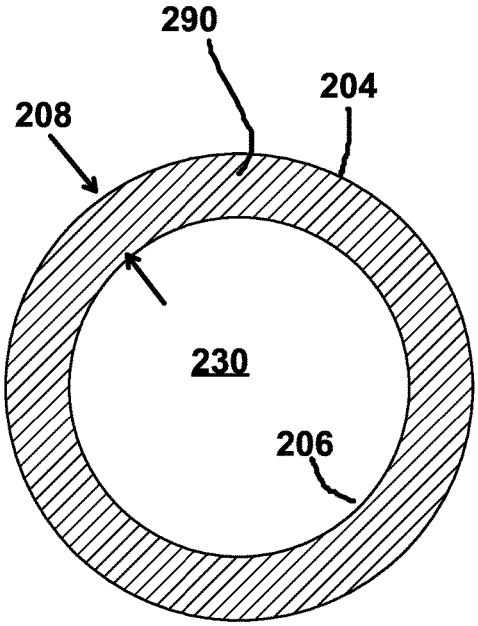
FIG. 7 is a sectional view of FIG. 5 taken along lines 6-6 showing a second embodiment of insulating ring.

FIG. 7 is a sectional view of a second embodiment of insulating ring 200 taken along lines 6-6. In this embodiment a solid insulating material 290 is provided in the gap 208 between interior 206 and exterior 204 of insulation ring 200. The total insulating effect of insulating material is the combination of: (i) insulating value of insulation material 290 and (ii) the insulating value of the interior wall 206 and exterior wall 204.

Figure 8:
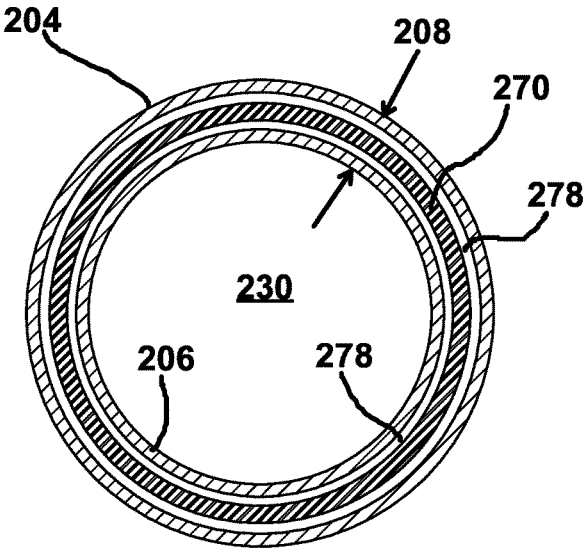
FIG. 8 is a sectional view of FIG. 5 taken along lines 6-6 showing a third embodiment of insulating ring.

FIG. 8 is a sectional view of a third embodiment of insulating ring 200 taken along lines 6-6. In this embodiment an insulating material 270 is provided in the gap 208 between interior 206 and exterior 204 of insulation ring 200. In various embodiments there also can be a gap or gaps 278 in this annular space between insulating material 270 and the gap 208. The total insulating effect of insulating material is the combination of: (i) insulating value of insulation material 270, (ii) insulating value of the gap(s) 278, and (iii) the insulating value of the interior wall 206 and exterior wall 204.

Figure 9:
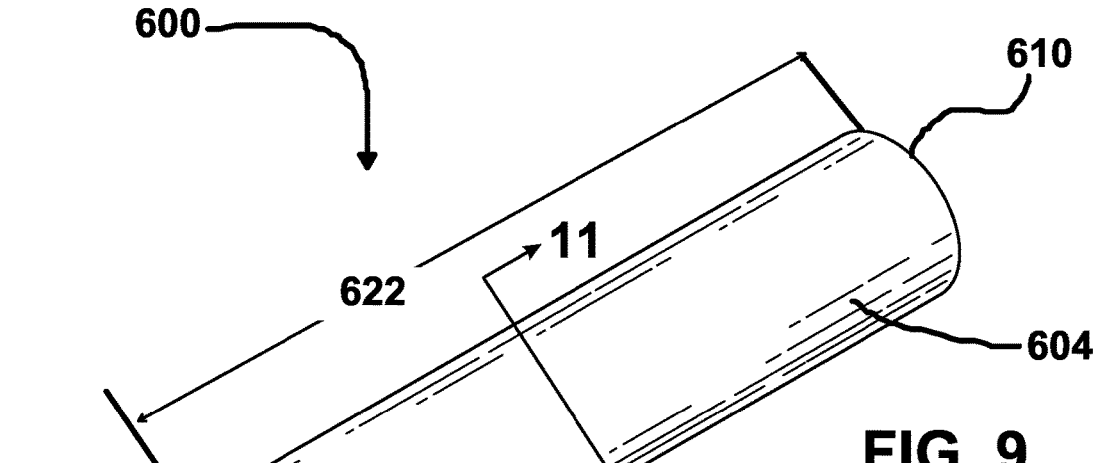
FIG. 9 is a perspective view of a supporting sleeve.
Figure 11:
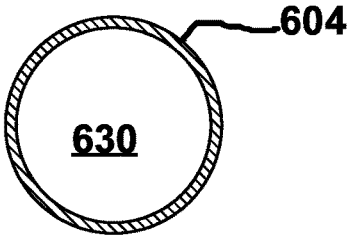
FIG. 11 is a sectional view of FIG. 9 taken along lines 11-11.

FIG. 9 is a perspective view of a supporting sleeve 600 which can comprise first end 610, second end 620, side wall 604, and interior 630. FIG. 11 is a sectional view supporting sleeve 600 taken along lines 11-11.

Figure 10:
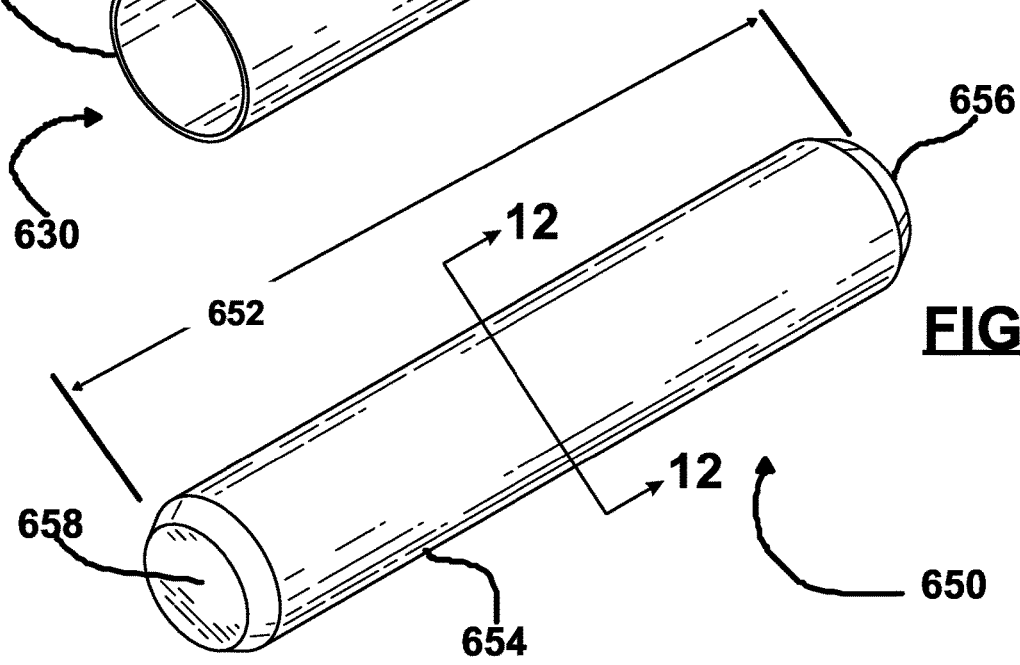
FIG. 10 is a perspective view of a form mandrel.
Figure 12:
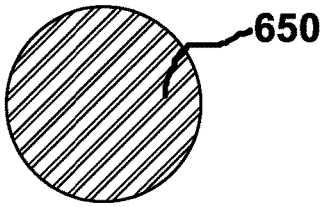
FIG. 12 is a sectional view of FIG. 10 taken along lines 12-12.

FIG. 10 is a perspective view of a generally solid form mandrel 650 which can comprise first end 656, second end 658, and outer surface 654. First 656 and second 658 ends can be tapered. FIG. 12 is a sectional view of general solid form mandrel 650 taken along lines 12-12.

Figure 13:
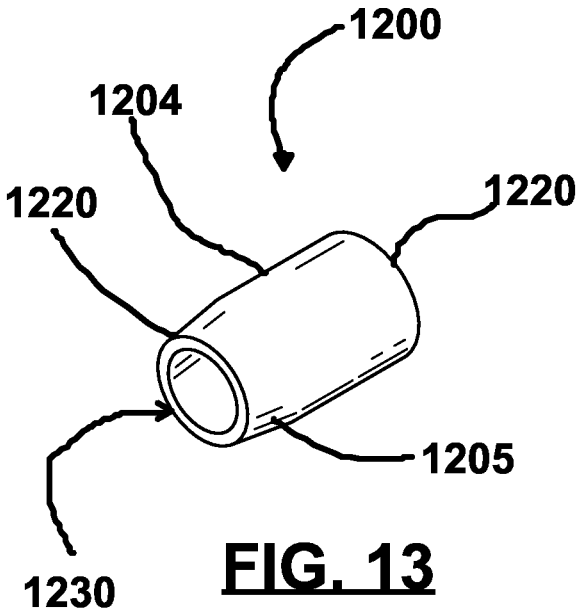
FIG. 13 is a sectional view of a removable filter tip.

FIG. 13 is a sectional view of a removable filter tip 1200 which can comprise first end 1210, second end 1220, side wall 1204, and interior 1230. Second end 1220 can be tapered 1205. Removable filter tip 1200 is conventionally available and is shown only schematically with opening 1230 being clear, however, conventionally available removable filter tips will have interiors constructed to allow smoking to pass by while blocking smokable filler and ashes.

Figure 14:
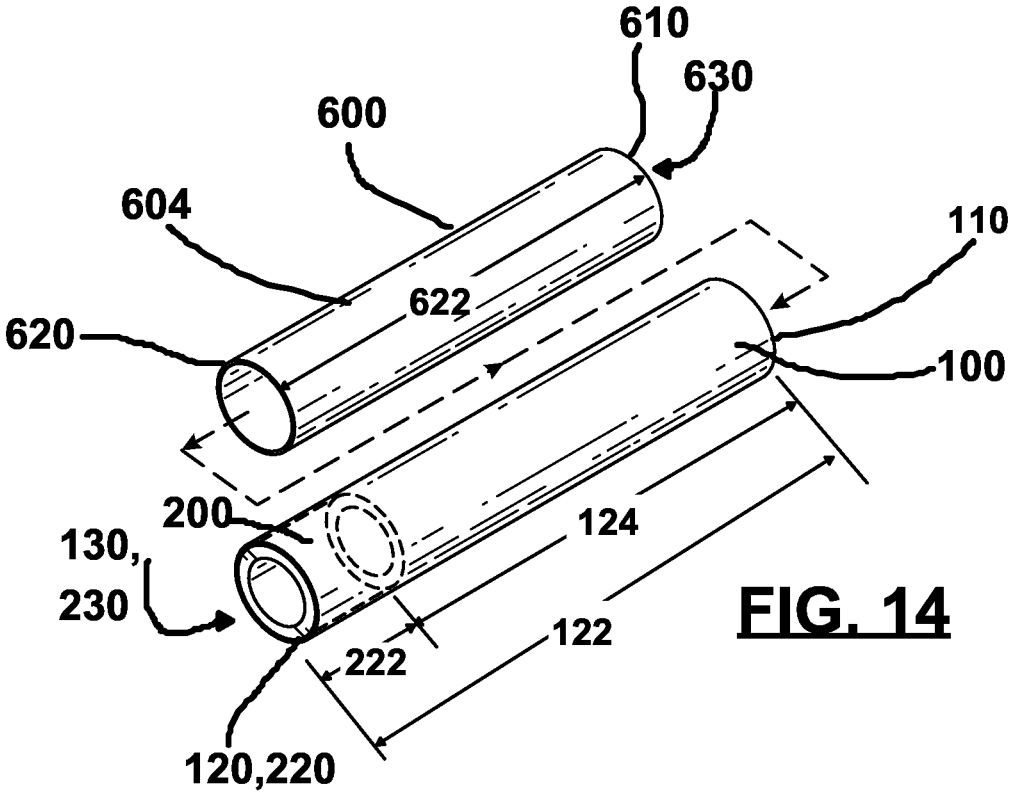
FIG. 14 is a perspective view of a cigar shell with insulating ring schematically indicating that supporting sleeve is being inserted into the interior of cigar shell.

FIG. 14 is a perspective view of a cigar shell 100 with insulating ring 200 schematically indicating that supporting sleeve 100 is being inserted into the interior 130 of cigar shell 100. The lengths of the major components can be: (i) dimension 122 for cigar shell 100, (ii) dimension 222 for insulating ring, and (iii) dimension 622 for supporting sleeve 600. Dimension 124 indicates the length of cigar shell 100 that remains following insulating ring. Because insulating ring 200 is shown preferably flush with second end 130 of cigar shell 100, dimension 222 plus dimension 124 would equal to dimension 122. Also in this embodiment the length (dimension 622) of supporting sleeve 600 is preferably equal to dimension 124. Alternatively, the length (dimension 622) of supporting sleeve 600 can be slightly larger than dimension 124 so that supporting sleeve 600 will stick out slightly from first end 110 of cigar shell 100 which can both (i) prevent damage to first end 110 of cigar shell 100 and (ii) facilitate the pulling out of support sleeve 600 from the interior 130 of cigar shell 100 (wherein sticking out first end 610 facilitates a user grabbing support sleeve 600 without having to touch first end 110 of cigar shell 100). Alternatively, insulating ring 200 can be slightly recessed into interior 130 of cigar shell 100 so that second end 120 of cigar shell 100 sticks out further than second end 220 of insulating ring 200 (however this embodiment is not preferred as it is believed that such would increase the risk of damage to second end 120 of cigar shell 100).

Figure 15:
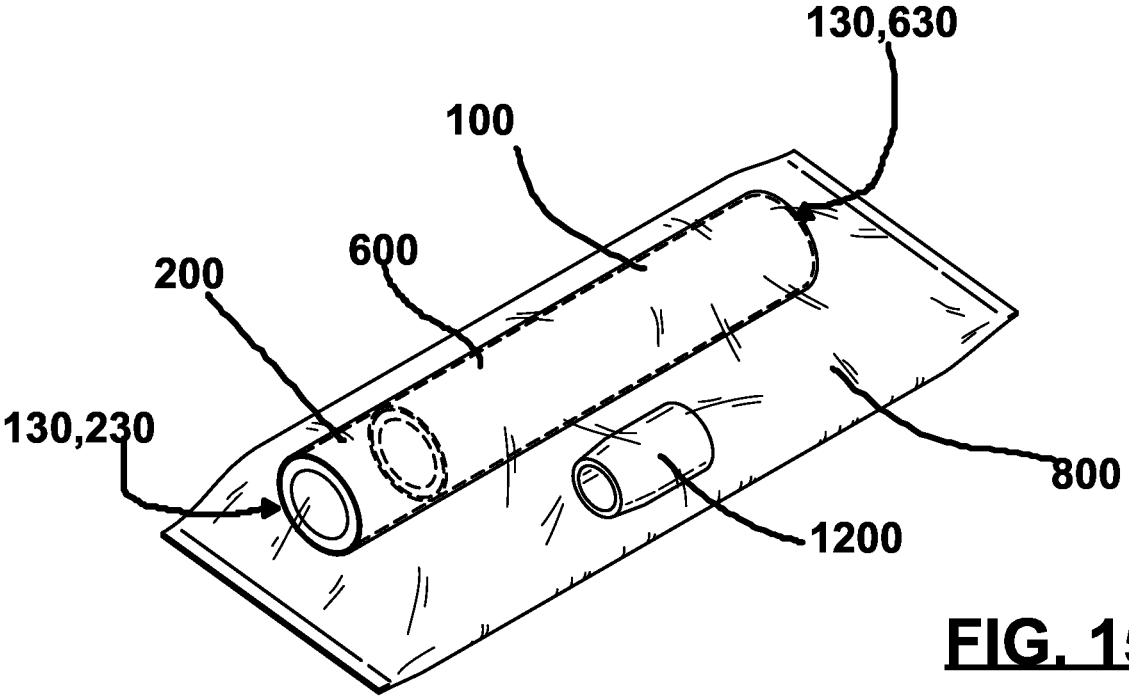
FIG. 15 is a perspective view of a cigar shell with insulating ring and inserted supporting sleeve packaged for sale with removable filter tip located adjacent cigar shell in the packaging.

FIG. 15 is a perspective view of a cigar shell 100 with insulating ring 200 and inserted supporting sleeve 600 packaged for sale in packaging 800 with removable filter tip 1200 located adjacent cigar shell 100 in the packaging. Removable filter tip 1200 is not located in the interior 130 of cigar shell 100 and the user has the option whether to use filter tip 1200 or some other blocking item relative to insulating ring 200. Cigar shell 100 is unfilled with smokable filler while located in packaging 800.

Figure 16:
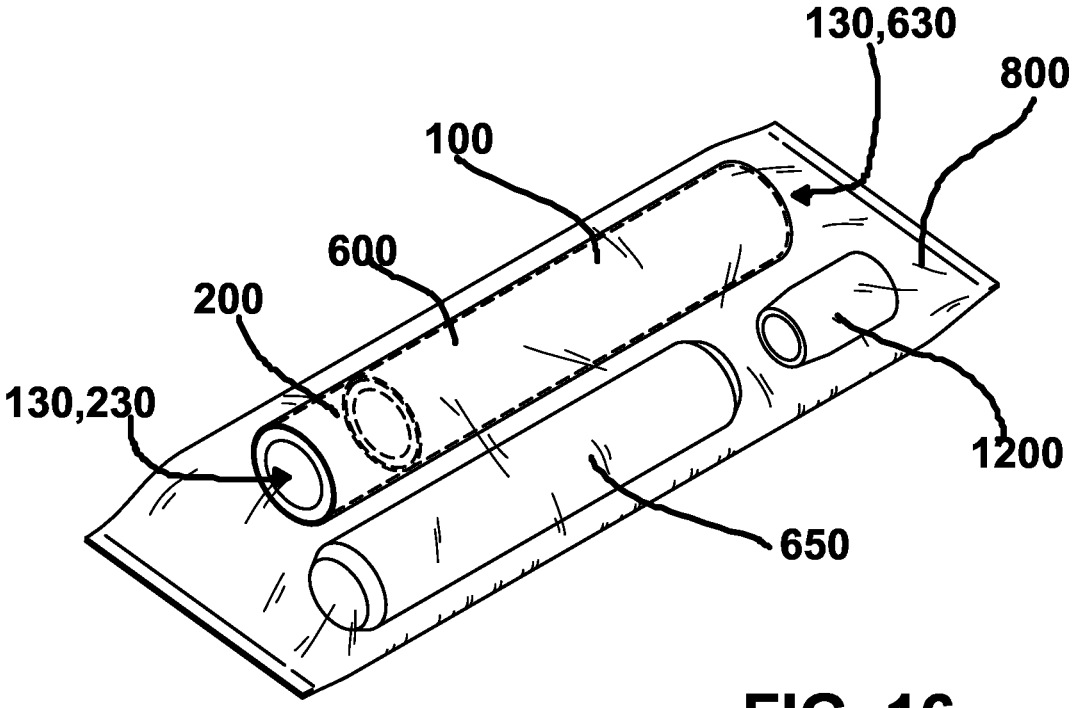
FIG. 16 is a perspective view of a cigar shell with insulating ring and inserted supporting sleeve packaged for sale with formal mandrel and removable filter tip located adjacent cigar shell in the packaging.

FIG. 16 is a perspective view of a cigar shell 100 with insulating ring 200 and inserted supporting sleeve 600 packaged for sale in packaging 800 with removable filter tip 1200 and form mandrel 650 located adjacent cigar shell 100 in the packaging. Both removable filter tip 1200 and form mandrel are not located in the interior 130 of cigar shell 100 and the user has the option whether to use filter tip 1200 or some other blocking item relative to insulating ring 200. Cigar shell 100 is unfilled with smokable filler while located in packaging 800.

Figure 17:
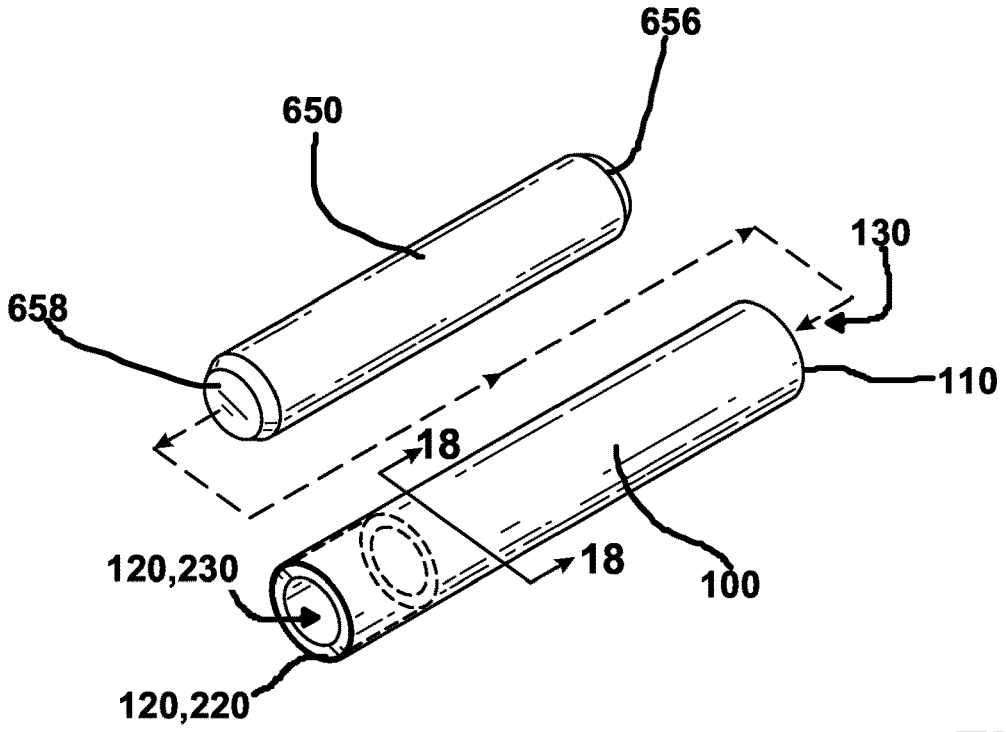
FIG. 17 is a perspective view of a cigar shell with insulating ring schematically indicating that a form mandrel is being inserted into the interior of cigar shell.
Figure 18:
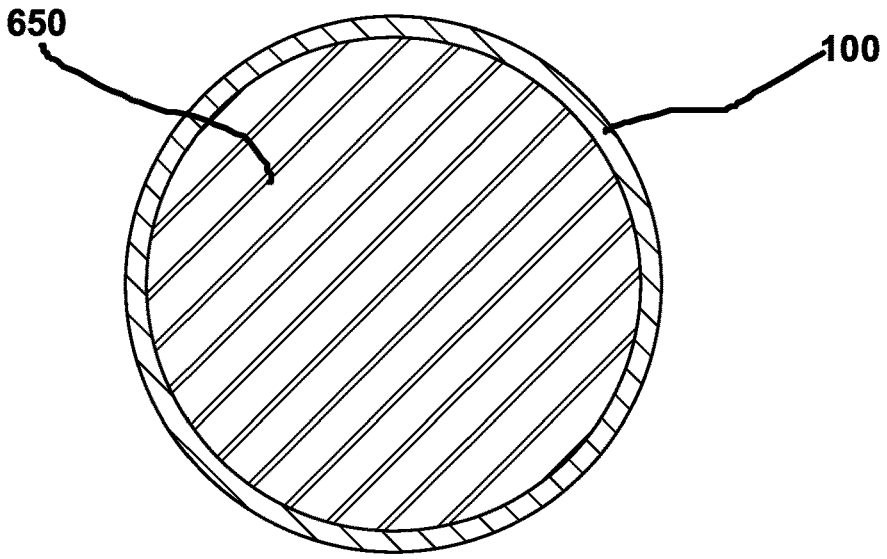
FIG. 18 is a sectional view of the cigar shell with insulating ring of FIG. 17 taken along lines 18-18.

FIG. 17 is a perspective view of a cigar shell 100 with insulating ring 200 schematically indicating that a form mandrel 650 is being inserted into the interior 130 of cigar shell 100. This is an alternative embodiment to that shown in FIGS. 14 and 15 where form mandrel 650 has replaced support sleeve 600. FIG. 18 is a sectional view of cigar shell 100 with insulating ring 200 taken along lines 18-18 showing form mandrel 650 being coaxially situated in cigar shell 100. With this alternative embodiment cigar shell 100 with insulating ring 200 and inserted form mandrel 650 are packaged for sale in packaging 800 with removable filter tip 1200 located adjacent cigar shell 100 in the packaging. Removable filter tip 1200 is not located in the interior 130 of cigar shell 100 and the user has the option whether to use filter tip 1200 or some other blocking item relative to insulating ring 200. Cigar shell 100 is unfilled with smokable filler while located in packaging 800.

Figure 19:
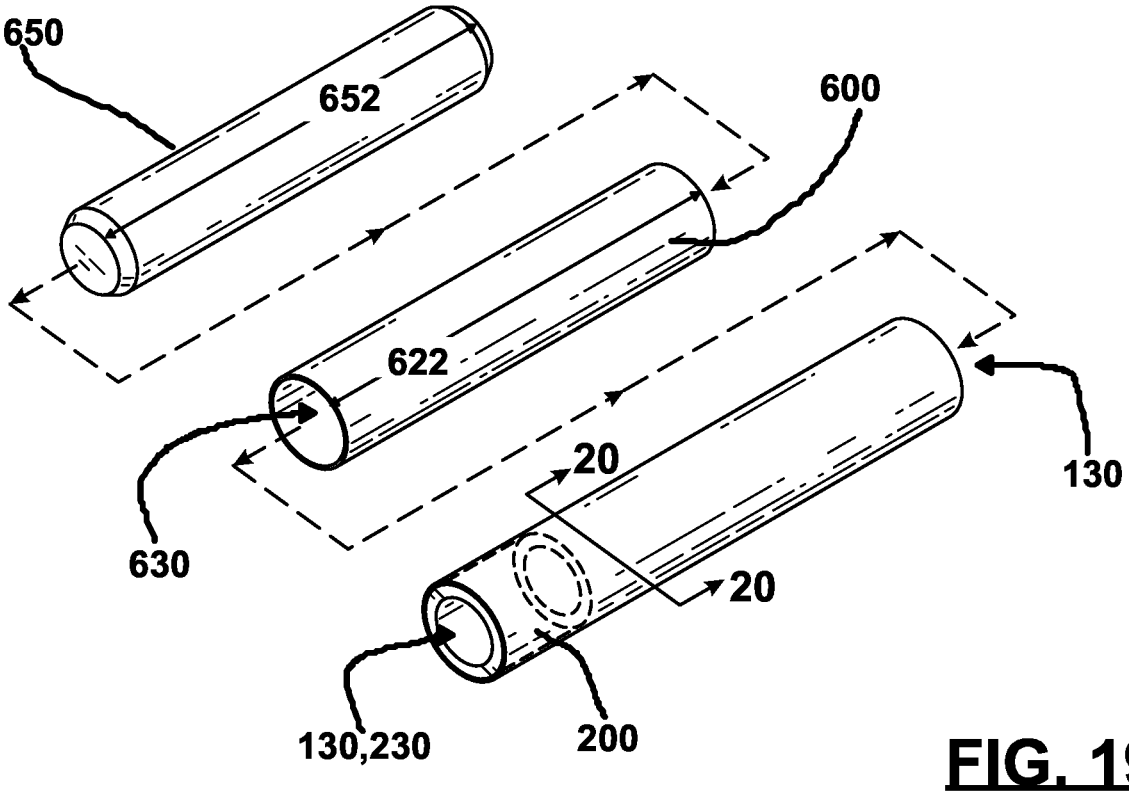
FIG. 19 is a perspective view of a cigar shell with insulating ring schematically indicating that a form mandrel is being inserted into the interior of supporting sleeve, and that the combination of form mandrel/supporting sleeve is being inserted into the interior of cigar shell.
Figure 20:
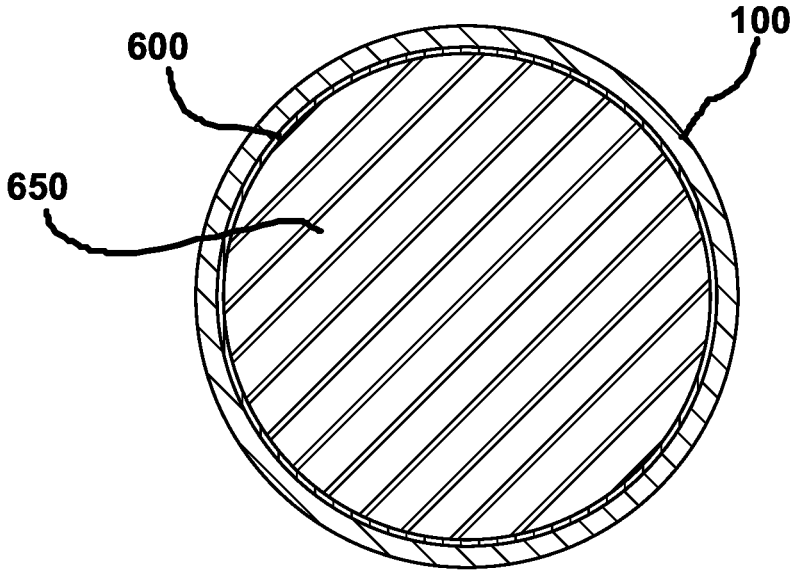
FIG. 20 is a sectional view of the cigar shell with insulating ring of FIG. 19 taken along lines 20-20.

FIG. 19 is a perspective view of a cigar shell 100 with insulating ring 200 schematically indicating that a form mandrel 650 is being inserted into the interior 630 of supporting sleeve 600, and that the combination of form mandrel 650/supporting sleeve 600 is being inserted into the interior 130 of cigar shell 100. This is another alternative embodiment to that shown in FIGS. 14 and 15 where now form mandrel 650 has been added to support sleeve 600. FIG. 20 is a sectional view of cigar shell 100 with insulating ring 200 taken along lines 20-20 showing the combined form mandrel 650/support sleeve 600 being coaxially situated in cigar shell 100. With this alternative embodiment cigar shell 100 with insulating ring 200 and inserted form mandrel 650/support sleeve 600 are packaged for sale in packaging 800 with removable filter tip 1200 located adjacent cigar shell 100 in the packaging. Removable filter tip 1200 is not located in the interior 130 of cigar shell 100 and the user has the option whether to use filter tip 1200 or some other blocking item relative to insulating ring 200. Cigar shell 100 is unfilled with smokable filler while located in packaging 800.

Figure 21:
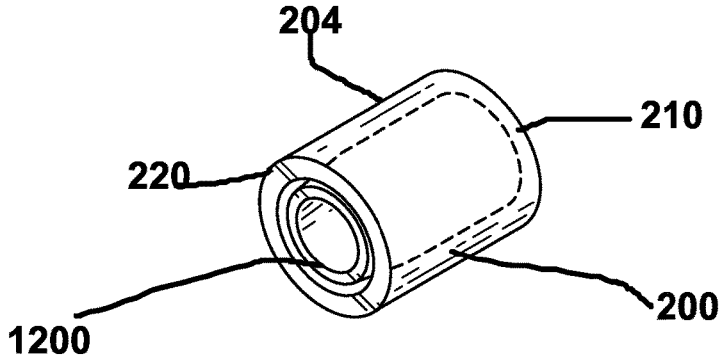
FIG. 21 is a perspective view of an insulating sleeve with removable filter tip inserted into the interior of insulating sleeve.
Figure 22:
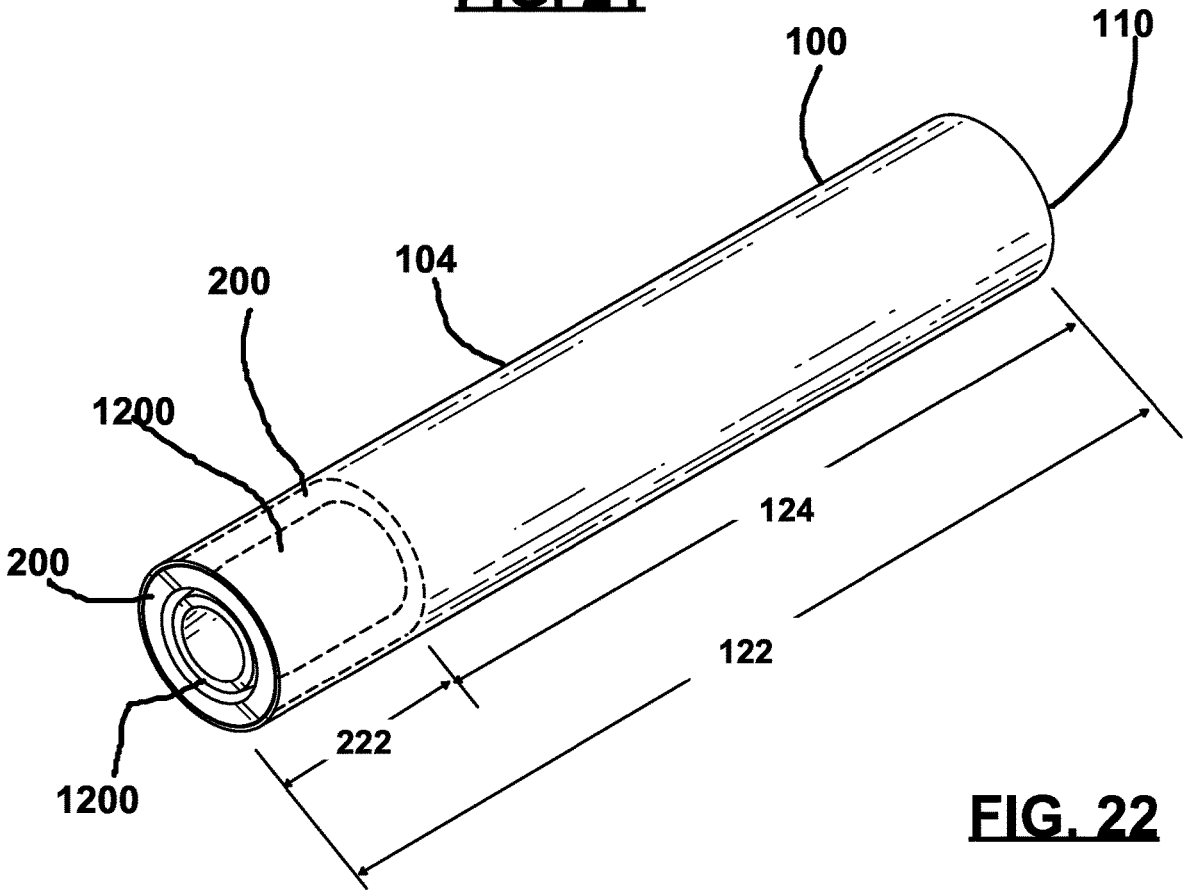
FIG. 22 is a perspective view of a cigar shell with insulating sleeve/removable filter tip inserted into the interior of cigar shell.

FIG. 21 is a perspective view of an insulating sleeve 200 with removable filter tip 1200 inserted into the interior 230 of insulating sleeve 200. FIG. 22 is a perspective view of a cigar shell 100 with the combined insulating sleeve 200/removable filter tip 1200 inserted into the interior 130 of cigar shell 100.

Figure 23:
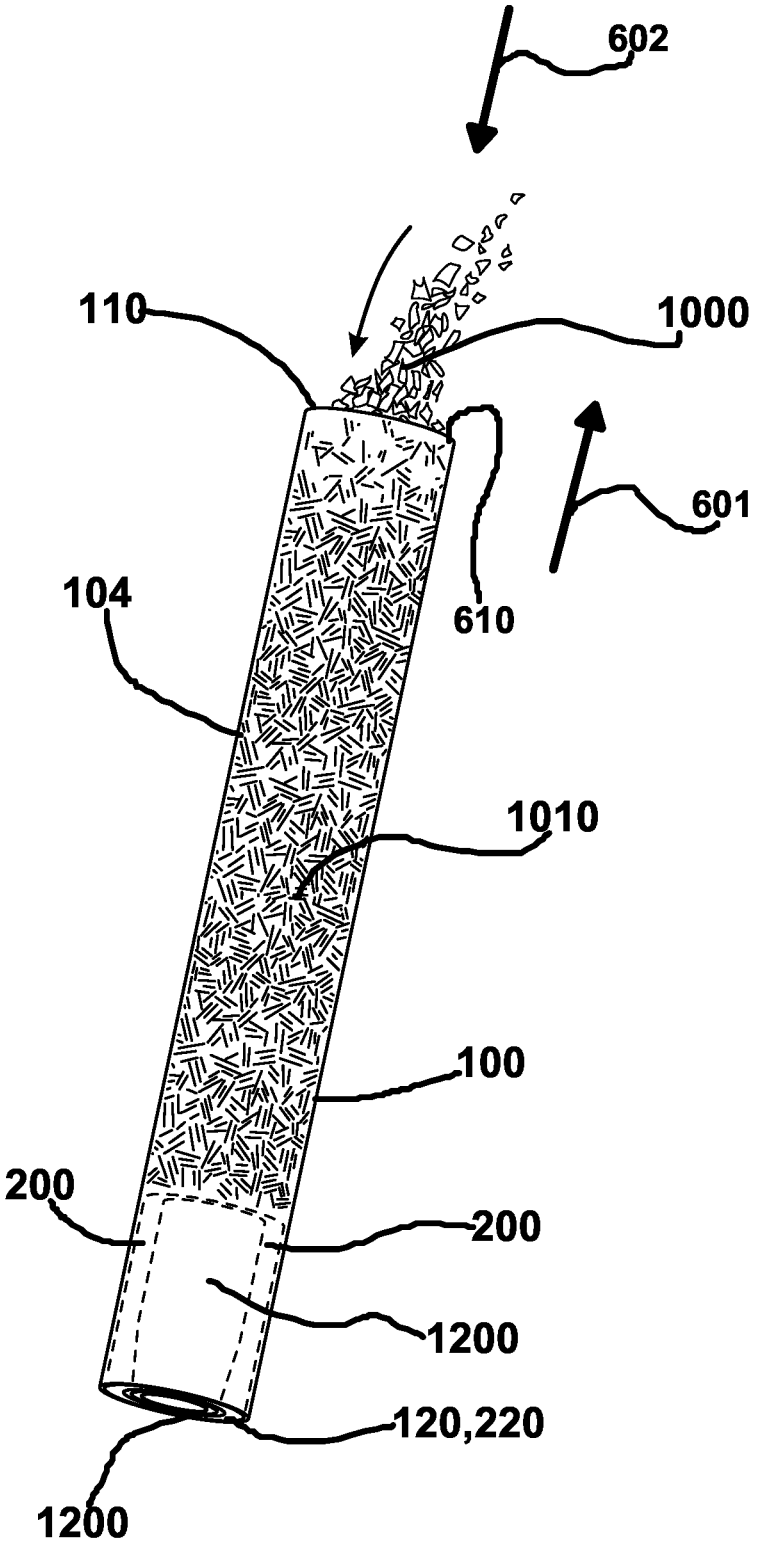
FIG. 23 is a perspective view of the cigar shell/insulating sleeve/removable filter tip of FIG. 22 being filled with smokable filler thereby making a finished cigar.

FIG. 23 is a perspective view of the interior 130 of cigar shell 100/insulating sleeve 200/removable filter tip 1200 being filled with smokable filler 1000 thereby making a finished cigar. Already added smokable filler 1010 is also shown. Optionally, support sleeve 600 as shown in FIG. 15 can be kept in the interior 130 of cigar shell 100 during the smokable filler 1000 filling process which is schematically shown in FIG. 23, and smokable filler 1000 can be added to the interior 630 of support sleeve 600 (which is also in the interior 130 of cigar shell 100 as support sleeve 600 is coaxially positioned in cigar shell 100). The added smokable filler 1000 can be compacted while in the interior 630 of support sleeve 600 and support sleeve 600 can resist the tearing of side wall 104 of cigar shell 100 during the filling and compaction process. At the end of the filling/compaction process of cigar shell 100, support sleeve 600 can be selectively removed from the interior 130 of cigar shell 100 by pulling on first end 610 of support sleeve 600 (schematically indicated by arrow 601) while using force on compacted smokable filler 1010 (schematically indicated by arrow 602) to prevent the compacted smokable filler 1010 from moving longitudinally relative to cigar shell thereby allowing support sleeve 600 to slide longitudinally relative to both smokable filler 1010 and sidewall 104. In one embodiment solid form mandrel 650 can be used to apply the force schematically indicated by arrow 602 to prevent the compacted smokable filler from sliding with support sleeve 600.

Figure 24:
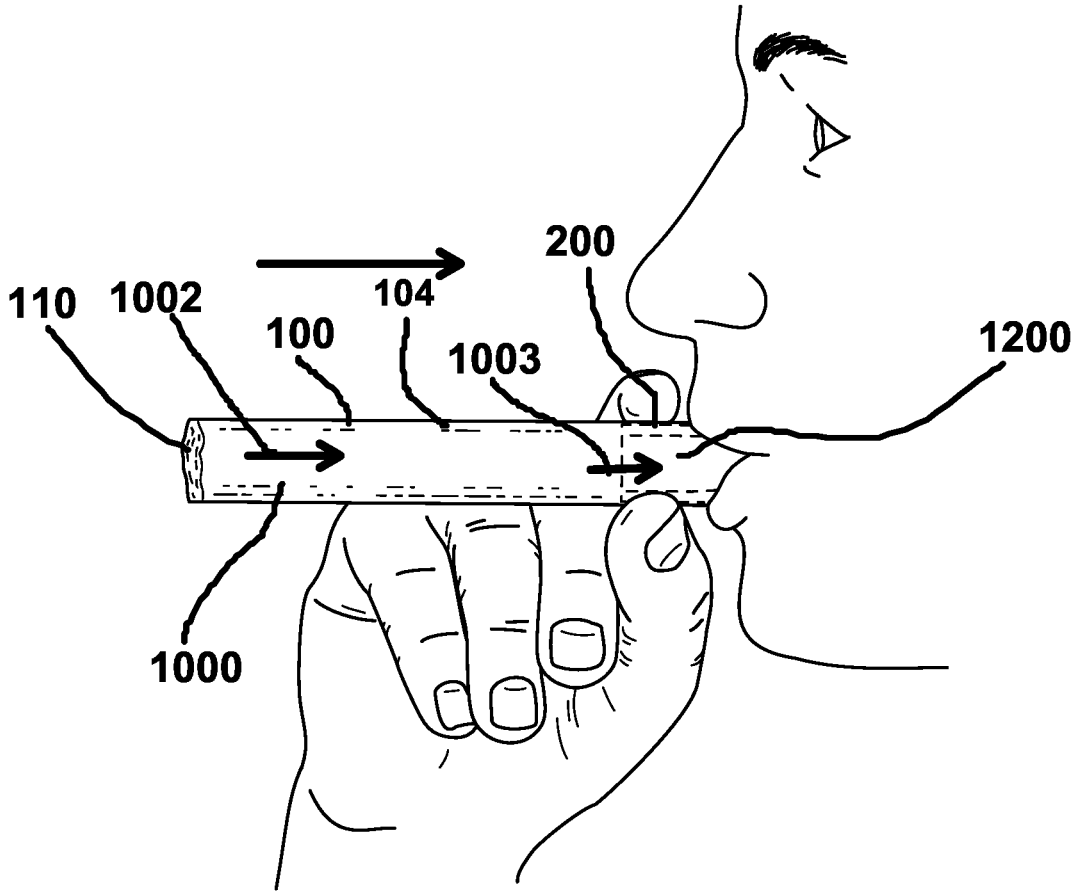
FIG. 24 is a side view showing a user smoking the finished cigar of FIG. 23.

FIG. 24 is a side view showing a user smoking the finished cigar 10. Arrow 1002 schematically indicates the flow of smoke while in the interior of cigar shell 100, and arrow 1003 schematically indicates the flow of smoke while in the interior of insulating ring 200 and filter tip 1200. As can be seen in this figure the user's fingers hold the finished cigar in the area of insulating ring 200.

Figure 25:
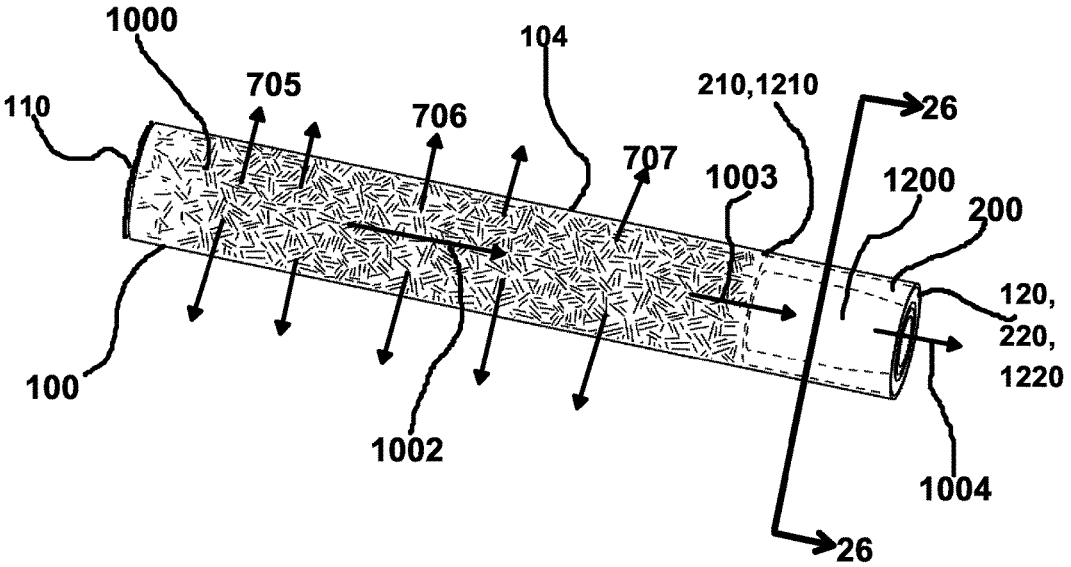
FIG. 25 is a perspective view of the cigar shell of FIG. 23 schematically indicating smoke flow along with heat flow about the length of the cigar shell.

FIG. 25 is a perspective view of the cigar shell 100 schematically indicating smoke flow along with heat flow about the length of the cigar shell. Arrows 705, 706, and 707 schematically indicate radiating heat flow from the lighted smoke which can freely leave the sidewall 104 of cigar shell 100. If a user were to touch this portion of the cigar shell 100 sidewall 104 can be very hot.

Figure 26:
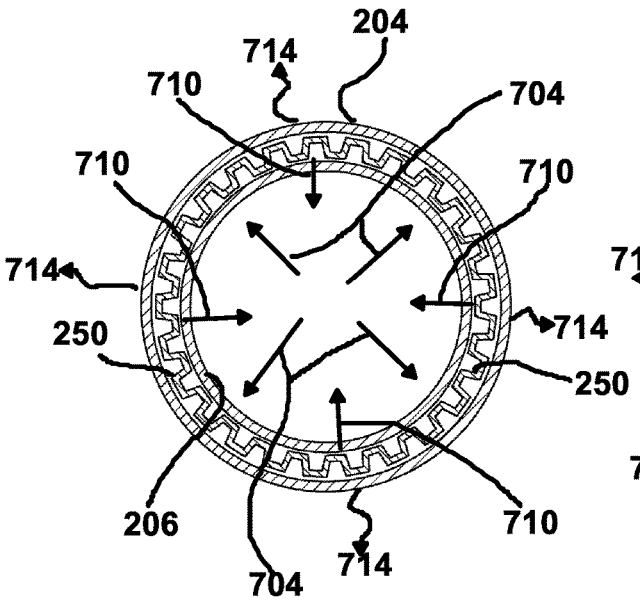
FIG. 26 is a sectional view of the cigar shell of FIG. 25 showing heat flow being schematically blocked by insulating ring.

FIG. 26 is a sectional view of the cigar shell 100 showing heat flow being schematically blocked by insulating ring 200 with insulation material 250. For clarity filter tip 1200 is not shown in this figure. Arrows 704 schematically indicate heat radiating from the smoke passing though filter tip 1200 and the interior 230 of insulating ring 200 while arrows 710 schematically indicate that the vast majority of the heat is blocked from passing though insulating ring 200 and thereby only a small fraction of this heat (schematically indicated by arrow 714) that the user's fingers will fee.

Figure 27:
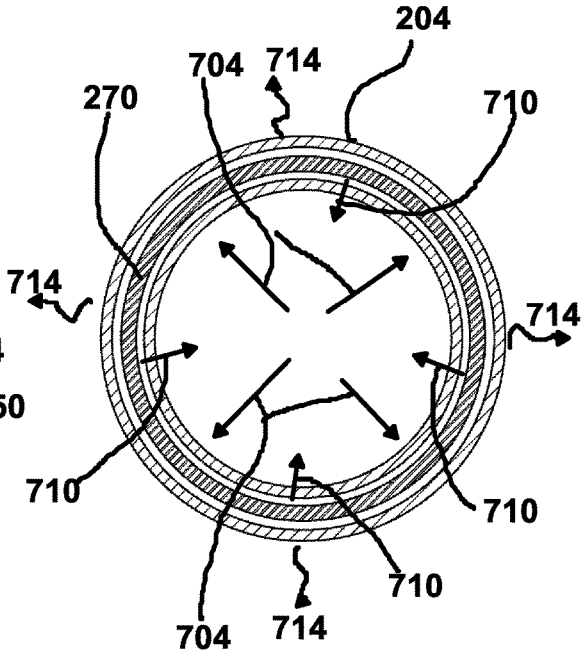
FIG. 27 is a sectional view of the cigar shell of FIG. 25 showing heat flow being schematically blocked by a different embodiment of an insulating ring.

FIG. 27 is a sectional view of the cigar shell 100 showing heat flow being schematically blocked by a different embodiment (of FIG. 8) of an insulating ring 200 with insulating material 270. Arrows 704 schematically indicate heat radiating from the smoke passing though filter tip 1200 and the interior 230 of insulating ring 200 while arrows 710 schematically indicate that the vast majority of the heat is blocked from passing though insulating ring 200 and thereby only a small fraction of this heat (schematically indicated by arrow 714) that the user's fingers will fee.

Thermal efficiency expresses the effectiveness of some particular piece of insulation in preventing heat loss from some particular surface. It may be written simply as the ratio or expressed as a percentage.

$$\text{Thermal efficiency}=[Q_{\text{without insulation}}-Q_{\text{with insulation}}]/Q_{\text{without insulation}}\times 100\%$$

In various embodiments the insulation efficiency of the insulator 200 can be at least 50, 55, 60, 65, 70, 75, 80, 85, 90, and 95 percent. In various embodiments insulator 200 can have a thermal efficiency falling within a range of between any two of the above specified insulation efficiencies. For example, insulator can preferably have a thermal efficiency of between 50 and 95 percent and more preferably between 76 and 90 percent.

The following is a Table of Reference Numerals used in this patent application:

TABLE OF REFERENCE NUMERALS:

| REFERENCE NUMBER | DESCRIPTION |
|---|---|
| 10 | smoking article |
| 100 | hollow shell |
| 101 | longitudinal centerline |
| 104 | sidewall |
| 110 | first end |
| 114 | inner surface |
| 120 | second end |
| 122 | dimension |
| 124 | dimension |
| 130 | interior |
| 140 | outer surface |
| 150 | first opening |
| 160 | second opening |
| 200 | insulating ring |
| 204 | outer surface |
| 206 | interior surface |
| 208 | dimension |
| 210 | first end |
| 220 | second end |
| 222 | dimension |
| 230 | interior |
| 250 | insulating material |
| 254 | plurality of ridges |
| 258 | plurality of valleys/gaps |
| 270 | insulating material |
| 278 | gaps |
| 290 | insulating material |
| 600 | hollow support mandrel |
| 601 | arrow |
| 602 | arrow |
| 604 | sidewall |
| 610 | first end |
| 620 | second end |
| 622 | dimension |
| 630 | interior |
| 650 | solid support mandrel |
| 652 | dimension |
| 654 | outer surface |
| 656 | first end |
| 658 | second end |
| 700 | heat flow |
| 704 | exterior and radially directed heat flow while inside insulating ring |
| 705 | exterior and radially directed heat flow in area closest to first end |
| 706 | exterior and radially directed heat flow in longtitudinal middle area |
| 707 | exterior and radially directed heat flow in area closest to second end and insulating ring |
| 710 | insulating ring reflected and interiorly directed heat flow |
| 714 | heat flow leaving insulating ring |
| 800 | package/wrapper |

-continued

TABLE OF REFERENCE NUMERALS:

| REFERENCE NUMBER | DESCRIPTION |
|---|---|
| 802 | arrow |
| 810 | closed end |
| 820 | open end |
| 830 | interior |
| 840 | seal |
| 900 | straw or tamper |
| 1000 | smokable filler |
| 1002 | arrow |
| 1003 | arrow |
| 1010 | smokable filler located in interior of shell |
| 1200 | filter |
| 1204 | outer surface |
| 1205 | tapered portion |
| 1210 | first end |
| 1220 | second end |
| 1230 | interior |
| 2000 | plane |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A smoking product comprising:

(a) a smoking tube having a tube wall, upper and lower tube ends, and a tube interior, wherein the tube wall has a first insulation value, (b) an insulator ring having outer and inner insulator ring walls, upper and lower insulator ends, an insulator annular area, and an open insulator interior, wherein the insulator ring is located in the tube interior, wherein the insulator annular area is filled with a first insulating material that is different from the outer and inner insulator ring walls, and wherein the insulator ring has an insulation efficiency that is at least 50 percent;

(c) a support having upper and lower support ends, wherein the support is inserted in the tube interior and resisting collapse of the tube wall against an external force applied to the tube wall;

(d) a filter element located outside of both the tube interior and the open insulator interior, wherein the filter element is selectably insertable into the open insulator interior; and (e) wherein the smoking tube, insulator ring, and filter element are packaged for sale in packaging, wherein smoking tube being un filled with a smokable filler.

2. The smoking product of claim 1, wherein the first insulator material is corrugated with a plurality of ridges and plurality of valleys which are sized to allow flow of smoke though the insulator annular interior while blocking smokable filler which may be placed in the tube interior.

3. The smoking of claim 1, wherein the lower support end contacts the insulator ring, and the upper support end extends out from the upper tube end.

4. The smoking product of claim 1, wherein smoking tube is cylindrically shaped, the insulator ring is cylindrically shaped, and the filter element is cylindrically shaped.

5. The smoking product of claim 1, wherein smoking tube is conically shaped, the insulator ring is conically shaped, and the filter element is conically shaped.

6. The smoking product of claim 1, wherein the first insulating material is corrugated.

7. The smoking product of claim 1, wherein the first insulating material is selected from the group consisting of: acetate.

8. The smoking product of claim 1, wherein the first insulating material is selected from the group consisting of: silicon, rubber, glass, cork, perlite, ceramic, teflon, and insulating foam.

9. The smoking product of claim 1, wherein the first insulating material is selected selected from the group consisting of: polyethylene, polyolefin, polyvinylchloride, polystyrene, polyester, nylon.

10. The smoking product of claim 1, wherein the insulation efficiency of the insulator is at least 60 percent.

11. The smoking product of claim 1, wherein the insulation efficiency of the insulator is at least 75 percent.

12. The smoking product of claim 1, wherein the insulation efficiency of the insulator is at least 80 percent.

13. The smoking product of claim 1, wherein the insulation efficiency of the insulator is at least 90 percent.

14. The smoking product of claim 1, wherein the insulation efficiency of the insulator is at least 95 percent.

15. A smoking product comprising:

(a) a smoking tube having a tube wall, upper and lower tube ends, and a tube interior, wherein the tube wall has a first insulation value, (b) an insulator ring having outer and inner insulator ring walls, upper and lower insulator ends, an insulator annular area, and an open insulator interior, wherein the insulator ring is located in the tube interior, wherein the insulator annular area is filled with a first insulating material, and wherein the insulator ring has an insulation efficiency that is at least 50 percent;

(c) a support having upper and lower support ends, wherein the support is inserted in the tube interior and resisting collapse of the tube wall against an external force applied to the tube wall;

(d) a filter element located outside of both the tube interior and the open insulator interior, wherein the filter element is selectably insertable into the open insulator interior; and (e) wherein the smoking tube, insulator ring, and filter element are packaged for sale in packaging, wherein smoking tube being un filled with a smokable filler.

16. The smoking product of claim 15, wherein the first insulator material is corrugated with a plurality of ridges and plurality of valleys which are sized to allow flow of smoke though the insulator annular interior while blocking smokable filler which may be placed in the tube interior.

17. The smoking product of claim 15, wherein the first insulating material is selected from the group consisting of: acetate.

18. The smoking product of claim 15, wherein the first insulating material is selected from the group consisting of: silicon, rubber, glass, perlite, cork, ceramic, teflon, and insulating foam.

19. The smoking product of claim 15, wherein the insulation efficiency of the insulator is at least 75 percent.

20. The smoking product of claim 15, wherein the insulation efficiency of the insulator is at least 95 percent.

21. A method of preparing a finished cigar comprising the steps of:

(a) receiving a smoking product comprising:

(i) a smoking tube having a tube wall, upper and lower tube ends, and a tube interior, wherein the tube wall has a first insulation value, (ii) an insulator ring having outer and inner insulator ring walls, upper and lower insulator ends, an insulator annular area, and an open insulator interior, wherein the insulator ring is located in the tube interior, wherein the insulator annular area is filled with a first insulating material, and wherein the insulator ring has an insulation efficiency that is at least 50 percent;

(iii) a support having upper and lower support ends, wherein the support is inserted in the tube interior and resisting collapse of the tube wall against an external force applied to the tube wall;

(iv) a filter element located outside of both the tube interior and the open insulator interior, wherein the filter element is selectably insertable into the open insulator interior; and (v) wherein the smoking tube, insulator ring, and filter element are packaged for sale in packaging, wherein smoking tube being un filled with a smokable filler;

(b) opening the packaging and removing the smoking tube and filter element;

(c) placing the filter element in the open insulator interior;

(d) placing smokable filler in the tube interior while the support remains inserted in the tube interior;

(e) after step "d", sliding the support relative to both the smokable filler and the tube wall and closing the first end of the smoking tube to form a finished smoking product; and (f) after step "e", while supporting the finished smoking product by grabbing outside of the insulator ring, lighting the smokable filler and causing smoke to flow through the tube interior and filter element.

* * * * *